US009125283B2

(12) United States Patent
Takemoto

(10) Patent No.: US 9,125,283 B2
(45) Date of Patent: Sep. 1, 2015

(54) LIGHT SOURCE APPARATUS

(71) Applicant: USHIO DENKI KABUSHIKI KAISHA, Tokyo (JP)

(72) Inventor: Fumitoshi Takemoto, Hyogo (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/207,709

(22) Filed: Mar. 13, 2014

(65) Prior Publication Data

US 2014/0265869 A1 Sep. 18, 2014

(30) Foreign Application Priority Data

Mar. 14, 2013 (JP) ..... 2013-051433

(51) Int. Cl.
*H05B 37/02* (2006.01)
*H05B 41/39* (2006.01)

(52) U.S. Cl.
CPC ..... *H05B 41/39* (2013.01)

(58) Field of Classification Search
USPC ..... 315/149–159; 340/514, 635, 657
See application file for complete search history.

(56) References Cited

U.S. PATENT DOCUMENTS

2011/0285526 A1* 11/2011 Tanaka et al. ..... 340/514
2012/0074850 A1* 3/2012 Tanaka et al. ..... 315/152

FOREIGN PATENT DOCUMENTS

JP 2010-027484 A 2/2010
JP 2010-027944 A 2/2010
JP 2011-175823 A 9/2011
JP 2012-048831 A 3/2012

* cited by examiner

*Primary Examiner* — Tung X Le

(57) ABSTRACT

A light source apparatus is adapted to be shared by excimer lamps. An IC tag is disposed at each lamp, and the IC tag stores information identifying the lamp. A storage unit of the light source apparatus stores information identifying a usable lamp (or usable lamps) for the light source apparatus, an emission wavelength of the lamp, and a sensitivity correction value of an optical sensor that corresponds to the emission wavelength. When the light source apparatus is driven to cause the lamp to light, the information stored in the IC tag and information stored in the storage unit are collated and it is determined whether the lamp is usable and the emission wavelength of the lamp is a preset emission wavelength. If it is determined that the lamp is usable and the emission wavelength is appropriate, the sensitivity of the optical sensor is corrected with the correction value.

4 Claims, 11 Drawing Sheets

Compatible Lamp Information

| Compatible Lamp Model | Dominant Wavelength (Emission Wavelength) | Sensitivity Correction Value |
|---|---|---|
| A | 230 nm | 0.57 |
| B | 290 nm | 0.69 |
| C | 320 nm | 0.63 |
| D | 340 nm | 1.00 |

FIG. 3A

IC Tag Data

| Lamp Model B |
|---|

FIG. 3B

Compatible Lamp Information

| Compatible Lamp Model | Dominant Wavelength (Emission Wavelength) |
|---|---|
| A | 230 nm |
| B | 290 nm |
| C | 320 nm |
| D | 340 nm |

FIG. 7A

IC Tag Data

| | |
|---|---|
| Lamp Model | B |
| Sensitivity Correction Value | 0.69 |

FIG. 7B

LIGHT SOURCE APPARATUS

FIELD OF THE INVENTION

The present invention relates to a light source apparatus for emitting ultraviolet rays used for, e.g., a curing process to be applied on an ultraviolet ray-reactive resin (referred to as "UV-reactive resin") or other processes in an electronic part manufacturing method or a semiconductor manufacturing method.

DESCRIPTION OF THE RELATED ART

Various types of UV-reactive resins are used in an electronic part or semiconductor manufacturing method and other methods, and the UV-reactive resins have different sensitivities depending upon the resin materials used. For example, when the resin material is sensitive to the light having a wavelength of 250 nm, the ultraviolet ray from a lamp must include a 250 nm wavelength light. When the other resin material is sensitive to the light having a wavelength of 300 nm, the ultraviolet ray from the lamp must include a 300 nm wavelength light.

In order to cope with such varieties of the sensitivities, a lamp that can emit various types of ultraviolet rays, such as a metal halide lamp, is conventionally employed in the above-mentioned manufacturing processes. However, such lamp also includes a wavelength that is sensitive to other materials than the resin material. Thus, when the resin material is irradiated with an undesired light, the resin material absorbs the light in the form of heat. This heat may damage or break the electronic part and/or semiconductor that contains such resin material.

In recent years, therefore, a fluorescent excimer lamp is more used because it can emit a light in a required wavelength range only. The fluorescent excimer lamp is characterized by a fact that it is possible to change a dominant wavelength (peak wavelength; occasionally referred to as "emission wavelength" in the following description) emitted from the lamp by changing a fluorescent material applied in a luminous tube.

One example of such fluorescent excimer lamp is a fluorescent lamp (peak wavelength is 230 nm) disclosed in Japanese Patent Application Laid-open Publication (Kokai) No. 2011-175823, and another example of such fluorescent excimer lamp is a fluorescent lamp (peak wavelength is 190 nm) disclosed in Japanese Patent Application Laid-open Publication No. 2012-48831. These references teach that it is possible to obtain different wavelengths by altering the kind of the fluorescent material applied in the luminous tube.

In such fluorescent excimer lamps, fluorescent materials applied in the luminous tube of the excimer lamp, in which a noble gas (rare gas) is enclosed, are only different. Outside dimensions (overall size) and lighting conditions of these excimer lamps are the same, and therefore it is possible to mount and use these excimer lamps on a light source apparatus having the same structure. As such, there is a demand for a light source apparatus that can be commonly used by these excimer lamps.

FIG. 10A of the accompanying drawings illustrates a schematic structure of a light source apparatus adapted to light the excimer lamp, and FIG. 10B of the accompanying drawings illustrates a schematic structure of another light source apparatus adapted to light the excimer lamp. Each of FIGS. 10A and 10B is a cross-sectional view, taken in a plane perpendicular to a tube axial direction of the lamp. Specifically, FIG. 10A illustrates a cross-sectional view of a light source apparatus configured to hold or mount a single lamp, and FIG. 10B illustrates a cross-sectional view of a light source apparatus configured to hold or mount a plurality of lamps.

As shown in FIGS. 10A and 10B, the light source apparatus has a metallic housing 101. Inside the housing 101, a single excimer lamp 100 is provided (FIG. 10A) or a plurality of excimer lamps 100 are provided (FIG. 10B). In FIG. 10B, the excimer lamps 10 are arranged side by side such that the tube axes extend in parallel to each other.

Each of the excimer lamps 100 in FIGS. 10A and 10B has a luminous tube 100*a* made from a dielectric material that transmits a vacuum ultraviolet light or ultraviolet light. A discharge gas containing xenon is enclosed in the luminous tube 100*a*, and a fluorescent material 100*c* is applied on the inner wall of the luminous tube. An outside electrode (i.e., mesh electrode) 100*b* is provided on an outer face of the luminous tube 100*a*. The housing 101 has an opening, and a light transmissive window 103 is fitted in the opening. The light emitted from the fluorescent material 100*c* of the excimer lamp 100 transmits the outside electrode or mesh electrode 100*b* and is radiated to the outside from the light transmissive window 103.

A partition wall 102 is provided inside the housing 101. In FIG. 10A, an optical sensor (light sensor) 15 is provided in the space enclosed by the partition wall 102 and the housing 101 to measure illuminance (intensity of illumination) of the light emitted from the lamp 100. In FIG. 10B, a plurality of sensors 15 are provided and associated with a plurality of lamps 100, respectively, to measure the illuminances of the lights emitted from the associated lamps 100 respectively. The light emitted from the fluorescent material 100*c* of each of the luminous tubes 100*a* shown in FIGS. 10A and 10B transmits the mesh-shaped outside electrode 100*b* and is received by the associated optical sensor 15 through the opening 104 of the partition wall 102.

The illuminance of each lamp measured by the associated optical sensor in FIGS. 10A and 10B is sent to a controller (will be described) of the light source apparatus. The light source apparatus has a lighting power source (or lighting power sources), and feeds electricity (electric power) from the light power source(s) to light the lamp(s). The controller controls the lighting power source(s) such that it performs a feedback control to ensure that the respective lamp has an appropriate illuminance.

In a certain type of known light source apparatus, an IC tag is attached to the excimer lamp, and information is read from the IC tag attached to the excimer lamp upon lighting the excimer lamp, so as to monitor an integrated time of lighting or other values.

Japanese Patent Application Laid-open Publications No. 2010-27944 and No. 2010-27484 disclose an excimer lamp in which xenon gas is enclosed in a luminous tube as luminous gas, and teach the IC tag attached to the excimer lamp. A light source apparatus of these references control the electricity fed to the excimer lamp based on the information recorded on the IC tag.

LISTING OF REFERENCES

Patent Literature 1: Japanese Patent Application Laid-open Publications No. 2011-175823

Patent Literature 2: Japanese Patent Application Laid-open Publications No. 2012-048831

Patent Literature 3: Japanese Patent Application Laid-open Publications No. 2010-027944

Patent Literature 4: Japanese Patent Application Laid-open Publications No. 2010-027484

SUMMARY OF THE INVENTION

As described above, the light source apparatus may be designed to be shared for lighting various types of excimer lamps that have the same lighting conditions but different emission wavelengths, and a fluorescent excimer lamp having a required emission wavelength may be mounted on the light source apparatus to obtain a light having a desired lighting wavelength. Such light source apparatus, however, has the following disadvantages.

As described earlier, if the emission wavelength of the fluorescent excimer lamp is altered by using a different fluorescent material applied in the luminous tube, the fluorescent material applied in the luminous tube is only different while the outer dimension (or shape or appearance) of the lamp is completely the same. Therefore, when such fluorescent excimer lamp is mounted on the light source apparatus, the wavelength of the excimer lamp mounted is not known from the appearance of the excimer lamp. It is not possible to confirm whether the excimer lamp having a required emission wavelength is mounted or not. Even if the excimer lamp is lit, it is difficult to confirm, by visual observation, whether the emitted light has the required wavelength.

If the lamp mounted on the light source apparatus does not have the required emission wavelength, it is not possible to sufficiently cure the UV-reactive resin, and therefore a defective product with an insufficiently cured UV-reactive resin would be manufactured.

In particular, when the light source apparatus is designed to mount a plurality of lamps and one wrong lamp is accidentally mounted such that only one of the lamps emits a light at a different wavelength, it is difficult to notice the wrong lamp. As a result, the above-described defective product may be manufactured.

A wrong excimer lamp having a different (unexpected) emission wavelength was intentionally mounted on the light source apparatus. Then, it was turned out that a desired illuminance was not obtained sometimes from that excimer lamp.

This type of light source apparatus uses an optical sensor to measure the illuminance of the associated lamp, and performs a feedback control such that the lamp emits a light at an appropriate illuminance.

However, the optical sensor has a light receiving element such as a silicon photodiode, and the light receiving element possesses a different sensitivity depending upon the wavelength.

FIG. 11 of the accompanying drawings shows one example of the sensitivity of the optical sensor. The horizontal axis indicates the wavelength, and the vertical axis indicates the sensitivity (relative value). As illustrated in the drawing, the sensitivity of the optical sensor greatly changes with the wavelength.

Accordingly, when a fluorescent excimer lamp that has a fluorescent material having a peak wavelength of, for example, 230 nm (referred to as "lamp A") is provided on the light source apparatus, and the setting is made to ensure appropriate lighting of the lamp Abut another fluorescent excimer lamp that has a fluorescent material having a peak wavelength of, for example, 190 nm (referred to as "lamp B") is also provided on the light source apparatus and lit, then it is impossible for the lamp B to emit a light at an appropriate illuminance. In other words, because the lamps A and B have different emission wavelengths and the sensitivity of the optical sensor of the lamp B becomes different from the optical sensor of the lamp A, the optical sensor of the lamp B determines that the illuminance of the lamp B is insufficient or excessive even if the illuminance of the lamp B is in fact appropriate.

As such, if the conventional light source apparatus is configured to appropriately perform the feedback control in accordance with the sensitivities of the illuminometers, the light source apparatus can control the illuminances of the lamps to appropriate values when the excimer lamps having the same emission wavelength are mounted on the light source apparatus. However, when the single light source apparatus is commonly used by plural kinds of excimer lamps having different emission wavelengths, not all the illuminance values of the lamps are controlled to appropriate values.

The present invention is proposed to overcome the above-described problems, and an object of the present invention is to provide an improved light source apparatus having a lighting power source (or sources) used for lighting different excimer lamps having the same lighting conditions but different wavelengths. The light source apparatus can emit a light of a desired wavelength at an appropriate illuminance, and can prevent an accidental mounting and lighting of a wrong lamp, which has a different emission wavelength or which cannot be used.

In order to achieve the above-mentioned object according to the present invention, an IC tag is attached to (disposed at) each of a plurality of excimer lamps used for a single light source apparatus, which is shared by the excimer lamps to light the excimer lamps. The excimer lamps have different wavelengths. Each of the IC tags stores, at least, information for specifying (identifying) the associated lamp (e.g., lamp model). A memory unit (storage unit) of the controller adapted to control the light source apparatus stores the information specifying (identifying) usable lamps (e.g., lamp model) for the light source apparatus, the emission wavelengths of the lamps, and correction values to the sensitivities of the optical sensors used in the light source apparatus that correspond to the emission wavelengths of the lamps respectively.

When the light source apparatus is activated to light the lamp(s), the light source apparatus reads the lamp identifying information from the IC tag, and collate the lamp identifying information with the information identifying the usable lamps for the light source apparatus stored in the storage unit in order to determine whether the lamp is usable or not and whether the emission wavelength of the lamp is the wavelength of a light which is necessary to treat a radiated object (radiation target).

If the lamp is the usable lamp and the emission wavelength of the lamp is appropriate, the sensitivity of the optical sensor of the light source apparatus is corrected with the correction value of the optical sensor sensitivity, and the lamp is lit. As a result, it is possible to emit a light having a desired wavelength at an appropriate illuminance, and prevent accidental mounting and lighting of a lamp having a different emission wavelength or an unusable lamp. Alternatively, the correction value to the optical sensor sensitivity may be recorded on the IC tag disposed at the lamp.

According to the present invention, the above mentioned problems are overcome as described below.

(1) According to one aspect of the present invention, there is provided a light source apparatus that includes a lighting power source configured to feed electricity to an excimer lamp at which an IC tag is disposed, an IC tag reading unit configured to read information from the IC tag disposed at the excimer lamp, an optical sensor configured to measure illuminance of a light emitted from the excimer lamp, and a controller configured to control the lighting power source according to an output from the optical sensor to control the illuminance of the excimer lamp. The lighting power source is configured to be shared among excimer lamps that have an equal lighting condition and different emission wavelengths. The controller is configured to store, at least, usable lamp information identifying an excimer lamp that is usable for the light source apparatus, and a sensitivity correction value for correcting a sensitivity of the optical sensor that corresponds to an emission wavelength of each of usable excimer lamps. The IC tag is configured to store (record), at least, lamp identifying information identifying an excimer lamp at which the IC tag is disposed.

When the light source apparatus is driven to cause the excimer lamp to light, the controller causes the IC tag reading unit to read information from the IC tag disposed at the lamp. The controller then is configured to determine whether the excimer lamp mounted on the light source apparatus is usable and capable of emitting a light at a desired emission wavelength based on the lamp identifying information recorded on the IC tag and the usable lamp information stored beforehand in the controller. If it is determined that the excimer lamp satisfies determination conditions, the controller is configured to allow the excimer lamp to normally light and corrects the sensitivity of the optical sensor with the sensitivity correction value stored in the controller.

(2) According to another aspect of the present invention, there is provided another light source apparatus. The light source apparatus includes a lighting power source configured to feed electricity to an excimer lamp at which an IC tag is disposed, an IC tag reading unit configured to read information from the IC tag disposed at the excimer lamp, an optical sensor configured to measure illuminance of a light emitted from the excimer lamp, and a controller configured to control the lighting power source according to an output from the optical sensor to control the illuminance of the excimer lamp. The lighting power source is configured to be shared among excimer lamps that have an equal lighting condition and different emission wavelengths. The controller is configured to store, at least, usable lamp information identifying an excimer lamp that is usable for the light source apparatus. The IC tag is configured to store (record), at least, lamp identifying information identifying an excimer lamp at which the IC tag is disposed, and a sensitivity correction value for correcting a sensitivity of the optical sensor that corresponds an emission wavelength of the excimer lamp at which the IC tag is disposed.

When the light source apparatus is driven to cause the excimer lamp to light, the controller is configured to determine whether the excimer lamp mounted on the light source apparatus is usable and capable of emitting a light at a desired emitting wavelength based on the lamp identifying information read from the IC tag by the IC tag reading unit and the usable lamp information stored in the controller. If the excimer lamp satisfies determination conditions, the controller is configured to allow the excimer lamp to normally light and corrects the sensitivity of the optical sensor by use of the sensitivity correction value read from the IC tag.

(3) The excimer lamp may be a xenon excimer lamp that has a luminous tube encapsulating rare gas therein, or a fluorescent excimer lamp that has a luminous tube encapsulating rare gas therein and is provided with a fluorescent material excited by a light from the rare gas.

(4) According to still another aspect of the present invention, there is provided a light source apparatus that is usable for a plurality of excimer lamps, with a plurality of IC tags being disposed at the excimer lamps, respectively. The light source apparatus includes a plurality of lighting power sources associated with the excimer lamps, respectively. Each lighting power source is configured to feed electricity to the associated excimer lamp. The light source apparatus also includes a plurality of IC tag reading units associated with the excimer lamps, respectively. Each IC tag reading unit is configured to read information from the associated IC tag disposed at the associated excimer lamp. The light source apparatus also includes a plurality of optical sensors associated with the excimer lamps, respectively. Each optical sensor is configured to measure illuminance of a light emitted from the associated excimer lamp. The light source apparatus also includes a controller configured to control each of the lighting power sources based on an output from the associated optical sensor to control the illuminance of the associated excimer lamp.

The controller is configured, when the excimer lamps are mounted on the light source apparatus, to determine whether an emission wavelength of each of the excimer lamps is identical with an emission wavelength of another excimer lamp based on the lamp identifying information read from the IC tag disposed at the each of excimer lamps. The controller is configured, if the emission wavelength of the each of the excimer lamps is determined to be identical with the emission wavelength of said another excimer lamp, to allow the each of the excimer lamps to normally light.

The present invention provides the following advantages:

(1) When the light source apparatus is activated to light the lamp, the lamp identifying information stored in the IC tag disposed at the lamp and the usable lamp information stored in advance in the controller are used to determine whether or not the lamp mounted on the light source apparatus is a usable lamp and is an excimer lamp configured to emit a light at a desired emission wavelength. Only when an appropriate lamp is mounted, that lamp is lit in a normal way. Accordingly, even if that lamp which cannot be used for the light source apparatus and which has different lighting conditions is accidentally mounted on the light source apparatus, the lamp will not be broken and/or the light source apparatus will not be damaged. Because the appropriateness of the emission wavelength of the lamp is determined (checked), it is possible to prevent that lamp which emits a light having an emission wavelength different from a desired emission wavelength from being mounted on the light source apparatus, and to prevent that product which has an insufficiently cured UV-reactive resin from being manufactured.

(2) Because the sensitivity of the optical sensor is corrected based on the emission wavelength of the lamp, it is possible to emit a light having a desired wavelength at a desired illuminance, even if optical sensor sensitivity changes with the wavelength. Thus, it is possible to prevent the illuminance of the light emitted on the radiation target from being insufficient or from being excessive.

These and other objects, aspects and advantages of the present invention will become apparent to those skilled in the art from the following detailed description when read and understood in conjunction with the appended claims and drawings.

BRIEF DESCRIPTION OF THE DRAWINGS

FIG. 3A shows an exemplary data stored in a storage unit according to the first embodiment.

FIG. 3B is another exemplary data stored in the storage unit according to the first embodiment.

FIG. 7A shows an exemplary data stored in the storage unit according to the second embodiment.

FIG. 7B is another exemplary data stored in the storage unit according to the second embodiment.

DETAILED DESCRIPTION OF THE INVENTION

First Embodiment

Figure 1:
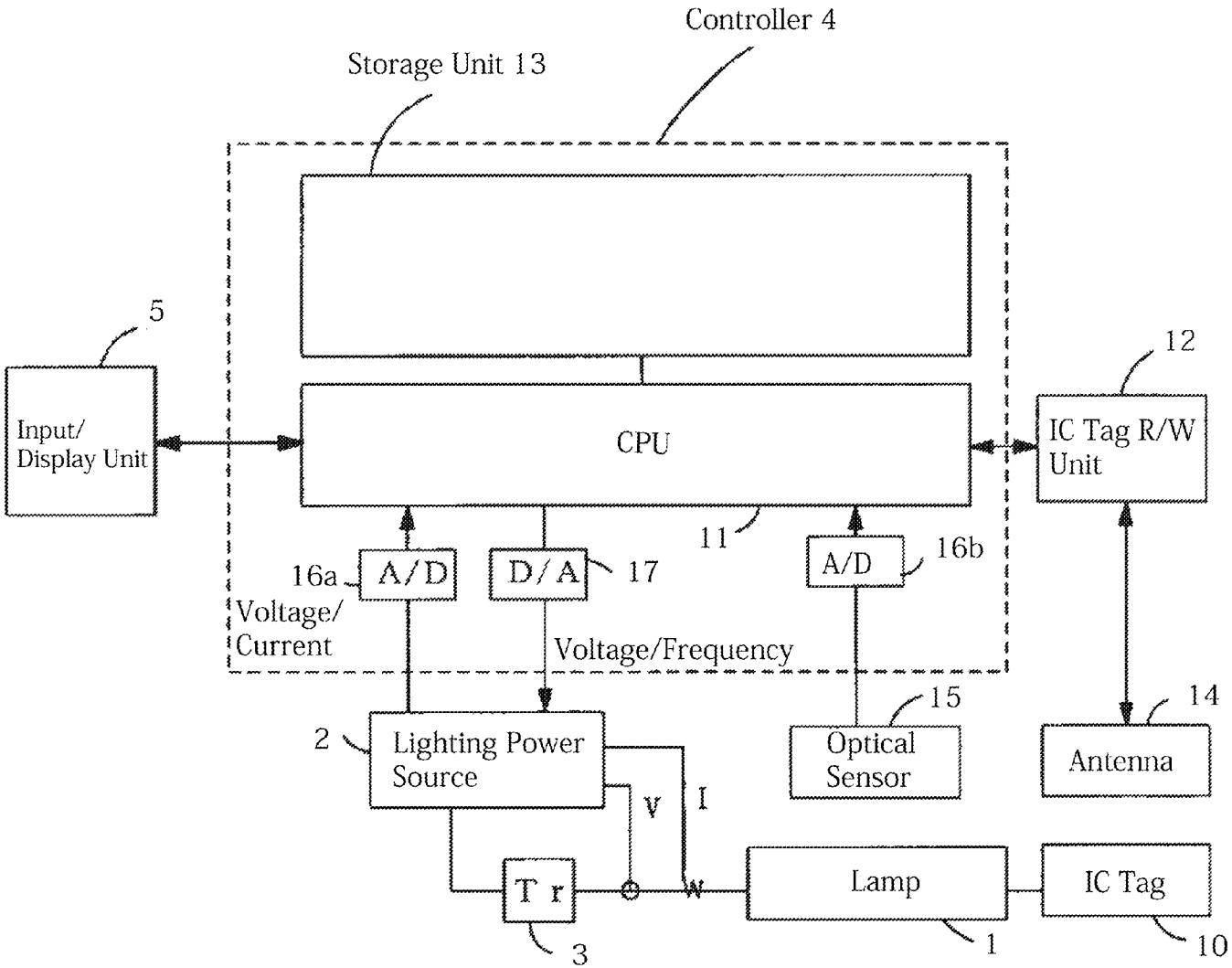
FIG. 1 illustrates a system configuration of a light source apparatus according to an embodiment of the present invention.

Referring to FIG. 1, a system configuration of a light source apparatus according to an embodiment of the present invention will be described.

As shown in FIG. 1, a light source apparatus of the present invention includes a light source (referred to as "lamp" hereinafter) 1 having an IC tag 10, a lighting power source 2 for feeding a high frequency high voltage to the lamp 1, a transformer 3 provided on an output side of the lighting power source 2, a controller 4 for controlling the lighting of the lamp 1, and an input-and-display unit 5. Information to be recorded on the IC tag 10 may be input into the IC tag 10 in a contactless manner. It should be noted that although one lamp 1 is shown in FIG. 1, a plurality of lamps may be provided in the light source apparatus.

The controller 4 includes an optical sensor 15, which is a detection unit, for detecting a light such as a vacuum ultraviolet light emitted from the lamp 1 to generate an illuminance signal. The controller 4 also includes an arithmetic processing unit (CPU) 11 for controlling the lighting of the lamp 1 based on the illuminance data of the optical sensor 15 and other information, a storage unit 13, and an antenna 14 for sending and receiving signals between the IC tag 10 and the controller 4. The controller 4 also includes an IC tag R/W (read/write) unit 14 for controlling the data reception and transmission between the IC tag 10 and the controller 4, A/D converters 16*a* and 16*b*, and a D/A converter 17. The A/D converter 16*a* converts the signal received from the lighting light source 2 to a digital signal and sends the digital signal to the CPU 11. The A/D converter 16*b* converts the signal received from the optical sensor 15 to a digital signal and sends the digital signal to the CPU 11. The D/A converter 17 converts the digital signal received from the CPU 11 to an analog signal and sends the analog signal to the lighting light source 2.

Although the IC tag R/W unit that can read and write the IC tag data is described in the foregoing, alternatively, the IC tag R/W unit may be replaced with an "IC tag reader" that only performs the reading of the IC tag data.

The storage unit 13 stores programs and data, and further stores IC tag data read from the IC tag of the lamp 1, data about the emission wavelength of the lamp and the like.

The IC tag 10 is attached to the lamp 1 (tag 10 is disposed at the lamp 1), and stores information that identifies the excimer lamp. It should be noted that the IC tag 10 may store a sensitivity correction value to be applied to the sensitivity of the optical sensor that corresponds to the emission wavelength of the lamp and may store related information (will be described).

The light source (lamp) 1 may be an excimer lamp that has a luminous tube. A fluorescent material is applied on an inner surface of the luminous tube, and discharge gas such as xenon gas is encapsulated (enclosed) in the luminous tube.

As described earlier, the light source apparatus of the present invention is a light source apparatus commonly used to light various excimer lamps having the same lighting conditions but different dominant wavelengths (emission wavelengths). The lamps used for the light source apparatus have the different emission wavelengths and the same lighting conditions.

In order for the same (single) light source apparatus to cause a plurality of lamps having different wavelengths to light, it is preferred that the same lighting gas (e.g., xenon gas) is enclosed in a luminous tube of each of the lamps. As long as the same lighting gas is used for all the lamps, a voltage and frequency to be applied to the lamps may be the same even if the fluorescent materials (phosphor) are different. If the lighting gas in the lamp A is xenon gas and the lighting gas in the lamp B is a mixture of krypton and chlorine and therefore the lighting gases are different from the lamp A to the lamp B, then it may be necessary to alter the voltage and frequency to be applied to the lamps and therefore it may not be possible to use a common (single) power source. Accordingly, it is preferred that the same lighting gas is used for all the lamps.

The CPU 11 of the controller 4 sends a instruction to the lighting power source 2 to control the electricity to be fed to the lamp 1 (will be described). The CPU 11 also performs a control, based on target illuminance entered from the input unit 5 and illuminance data detected by the optical sensor 15, such that the illuminance of the vacuum ultraviolet light emitted from the lamp 1 becomes equal to the target illuminance. In association with this control, the controller 4 (CPU 11) corrects the illuminance data generated from the optical sensor 15 based on the sensitivity correction value of the optical sensor stored in the storage unit or the sensitivity correction value read from the IC tag.

The input-and-display unit 5 is for example a touch panel having a LCD (liquid crystal display) screen or the like. The input-and-display unit 5 is operated by a user of the light source apparatus to input target illuminance that relates to the illuminance of the vacuum ultraviolet light necessary for each object to be treated, to input the wavelength data of the emitted light, or to display the output data from the CPU 11.

Figure 2:
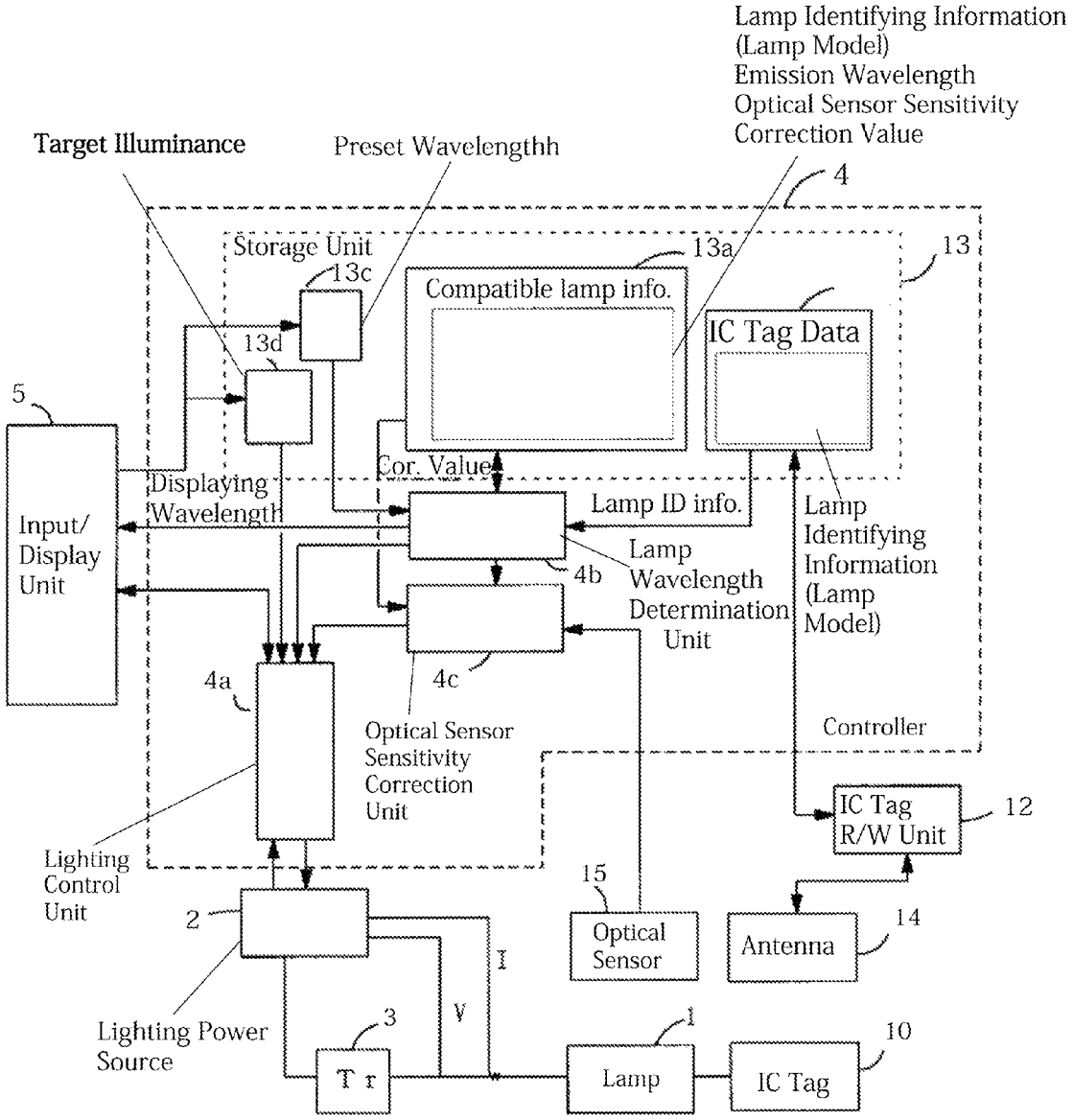
FIG. 2 is a functional block diagram of a light source apparatus of a first embodiment of the present invention.

FIG. 2 shows a functional block diagram of the light source apparatus according to the first embodiment of the present invention. FIGS. 3A and 3B illustrate examples of data to be stored in the storage unit in this embodiment. FIG. 2 depicts the inner configuration of the controller 4 in the form of functions realized by the processing executed by the CPU 11.

In FIG. 2, information (e.g., lamp model; see FIG. 3B) identifying the lamp 1, to which the IC tag 10 is attached, is stored in the IC tag 10 in the first embodiment.

When the lamp 1 is mounted on the light source apparatus and the light source apparatus is activated, the data recorded in the IC tag is read, as the IC tag data 13*b*, via the antenna 14 and the IC tag R/W unit 12, and stored in the storage unit 13.

Information, such as compatible lamp information 13*a*, target illuminance 13*d* and preset wavelength 13*c*, necessary to operate the apparatus are entered from the input-and-display unit 5 in advance, and is stored in the storage unit 13.

The preset wavelength 13*c* is information to set the wavelength of the light to be emitted from the light source apparatus. For example, when the light source apparatus is used to cure the UV-reactive resin and the wavelength of the light necessary to cure the UV-reactive resin is for example 250 nm, then 250 nm is set as the preset wavelength 13*c*.

The target illuminance 13*d* is a target value when the illuminance is feedback controlled. The control is performed such that the illuminance measured by the optical sensor becomes equal to the target illuminance 13*d*. It should be noted that the target illuminance 13*d* may be alternatively recorded in the IC tag 10, and the target illuminance 13*d* may be stored in the storage unit 13 when the IC tag data 13*b* is read.

FIG. 3A shows an example of the compatible lamp information 13*a* in the first embodiment. For example, the lamp model that can be used for the light source apparatus, the dominant wavelength (emission wavelength) of the light emitted from that model of lamp, and the sensitivity correction value of the optical sensor are registered as the compatible lamp information 13*a*.

Figure 4:
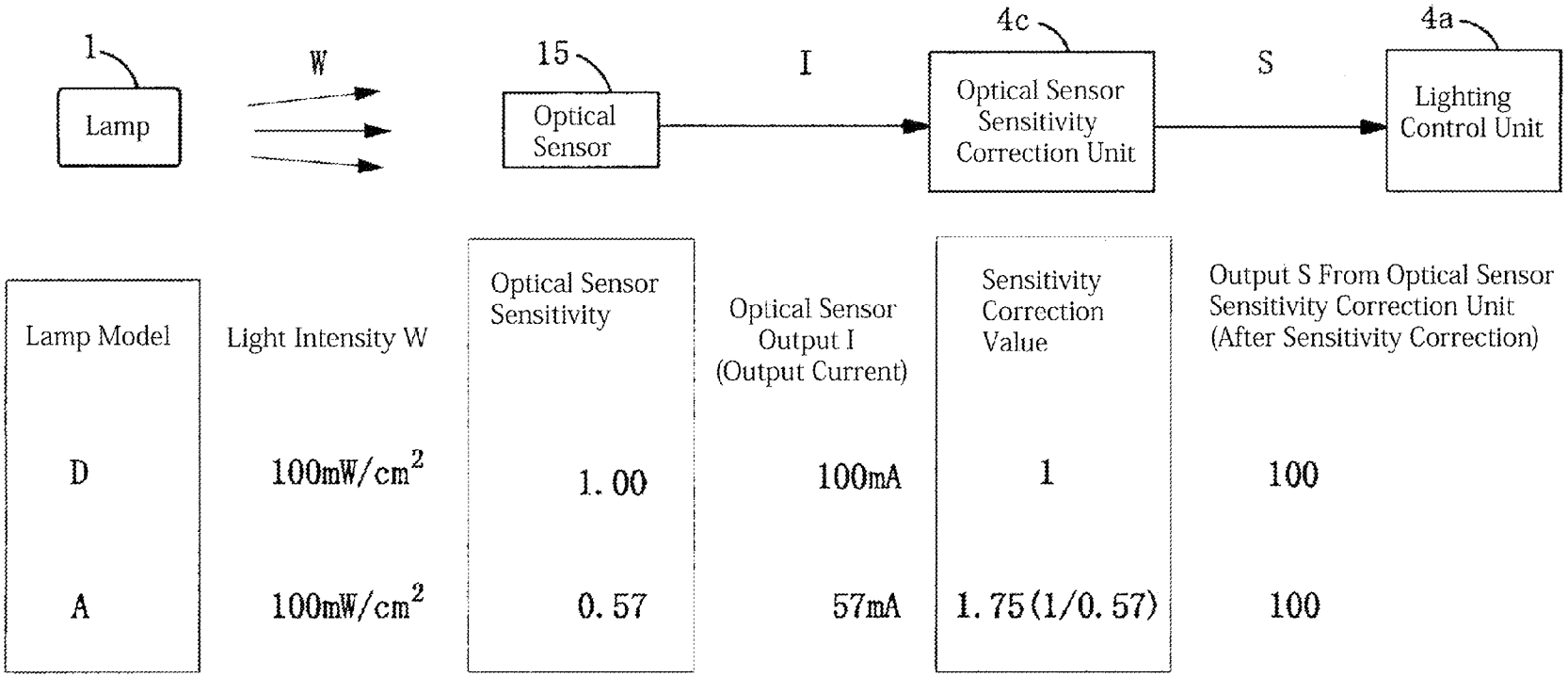
FIG. 4 illustrates corrections to sensitivities of optical sensors.

Referring now to FIG. 4, the correction to the sensitivity of the optical sensor will be described. In the following description, the sensitivity correction to the lamp of the model D (referred to as "lamp D") and the lamp of the model A (referred to as "lamp A") will be described.

It is assumed that a light of 100 mW/cm$^2$ is emitted from the lamp D and lamp A, respectively. One optical sensor 15 is associated with the lamp D and another optical sensor 15 is associated with the lamp A. The sensitivity of the optical sensor 15 changes with the wavelength of the light emitted from the lamp. The sensitivity of the optical sensor to the wavelength of the light emitted from the lamp D is 1.00, and the sensitivity of the optical sensor to the wavelength of the light emitted from the lamp A is 0.57.

As shown in FIG. 4, therefore, a photoelectric current I generated from the optical sensor 15 is 100 mA for the lamp D, and a photoelectric current I generated from the optical sensor 15 is 57 mA for the lamp A.

If signals representative of these photoelectric currents are sent to the lighting control unit 4*a* without any extra processing, then it would be determined that the optical output of the lamp A is 57 although the optical output of the lamp A is in fact 100. In other words, it would be determined that the optical output of the lamp A is insufficient although the lamp A in fact emits a light normally.

To avoid this, the optical sensor sensitivity correction unit (s) 4*c* is (are) provided as shown in FIG. 4. In the sensitivity correction unit 4*c*, the optical sensor output I of the lamp D is multiplied by a sensitivity correction value 1 (one), and the optical sensor output I of the lamp A is multiplied by a sensitivity correction value 1.75. 1.75 is obtained by dividing 1 by 0.57 (optical sensor sensitivity). As a result of such processing, the measurement results of the optical sensors to be sent to the lighting control unit 4*a* become 100 for both of the lamps A and D. Accordingly, it is determined that both of the lamps A and D emit the lights normally.

In FIG. 2, when the light source apparatus is activated, the IC tag R/W unit 12 reads the IC tag data 13*b* from the IC tag 10 of the lamp 1 mounted on the light source apparatus, and stores the IC tag data 13*b* in the storage unit 13.

The lamp wavelength determination unit 4*b* reads the lamp identifying information (e.g., lamp model) which is the information of the lamp mounted on the light source apparatus. The lamp identifying information is stored in the storage unit 13.

Then, the lamp wavelength determination unit 4*b* determines whether the lamp model of the lamp concerned is registered as a compatible lamp in the compatible lamp information 13*a* stored in the storage unit 13. If the lamp model recorded in the IC tag 10 is not included in the listing of compatible lamp models of the compatible lamp information 13*a*, or no tag is attached to the lamp 1 and therefore no lamp identifying information can be obtained from the IC tag 10, then the lamp wavelength determination unit 4*b* sends an alarming signal, which indicates "lamp unusable" or the like, to the input-and-display unit 5.

If the lamp model recorded in the IC tag 10 is included in the listing of the compatible lamp models of the compatible lamp information 13*a*, the lamp wavelength determination unit 4*b* reads an emission wavelength, which corresponds to the lamp model recorded in the IC tag 10, from the compatible lamp information 13*a* and compares the emission wavelength with the preset wavelength 13*c* registered in the storage unit 13 to determine whether the emission wavelength coincides with the preset wavelength 13*c*.

When the emission wavelength read from the compatible lamp information 13*a* does not coincide with the preset wavelength 13*c*, the lamp wavelength determination unit 4*b* sends an alarming signal that indicates "lamp unusable" or the like to the input-and-display unit 5, in the same manner as described above. The lamp wavelength determination unit 4*b* also sends the emission wavelength, which is read from the compatible lamp information 13*a*, to the input-and-display unit 5 to display the emission wavelength on the input-and-display unit 5.

On the other hand, when the emission wavelength read from the compatible lamp information 13*a* coincides with the preset wavelength 13*c*, the lamp wavelength determination unit 4*b* causes the input-and-display unit 5 to display, for example, "lamp usable," and to display the emission wavelength read from the compatible lamp information 13*a*. Then, the lamp wavelength determination unit 4*b* reads from the compatible lamp information 13*a* the sensitivity correction value that corresponds to the lamp model recorded in the IC tag 10, and sets the sensitivity correction value into the optical sensor sensitivity correction unit 4*c*.

For example, when the lamp A (its peak wavelength is, for example, 230 nm) is mounted on the light source apparatus, the controller 4 reads the IC tag data 13*b* from the IC tag, and checks if the lamp of this model is registered in the compatible lamp information 13*a* of the storage unit 13.

If the lamp model A is registered in the compatible lamp information 13*a*, and the emission wavelength of this lamp (230 nm) is the preset wavelength 13*c*, then the controller 4 causes the input-and-display unit 5 to display the emission wavelength of the lamp, i.e., 230 nm, and to display "lamp usable." The controller 4 then reads the sensitivity correction value of 0.57, which corresponds to the lamp model A recorded on the IC tag 10, from the compatible lamp information 13*a*, and sets the sensitivity correction value in the optical sensor sensitivity correction unit 4*c*.

When the above-described processing determines that a lamp which is usable and compatible for the light source apparatus is mounted on the light source apparatus, then the lighting control unit 4*a* of the controller 4 starts the lighting operation.

The lighting control unit 4*a* reads the target illuminance 13*d* stored in the storage unit 13. In order to obtain (achieve) the target illuminance 13*d*, the controller 4 controls the lighting power source 2 such that the electricity fed to the lamp 1 results in the target illuminance.

Specifically, the voltage applied to the lamp 1 is detected and the lamp current is also detected. The voltage and current are converted to digital signals by the A/D converter 16*a* (see FIG. 1), and the digital signals are sent to the lighting control unit 4*a* of the controller 4. The lighting control unit 4*a* calculates the electricity fed to the lamp from the above-mentioned voltage and current, and compares the calculated electricity with the target electricity. The lighting control unit 4*a* calculates the lamp voltage and frequency such that the calculated electricity becomes equal to the target electricity. The lamp voltage and frequency are introduced to the lighting power source 2 as the voltage instruction and the frequency instruction.

The lighting power source 2 controls the drive voltage and frequency of the lamp 1 based on the voltage instruction and the frequency instruction. As such, the electricity fed to the lamp 1 is controlled to become equal to the target electricity, and therefore the lamp 1 emits a light at an illuminance that corresponds to the target electricity.

The illuminance of the light emitted from the excimer lamp decreases over time, even if the same electricity is fed to the excimer lamp. Thus, in the initial lighting period, the electricity which corresponds to the target electricity data is fed to the lamp 1, and therefore the lamp 1 is lit at the illuminance which coincides with the target illuminance, but eventually the illuminance of the lamp 1 drops as the time elapses.

The lighting control unit 4*a* of the controller 4 corrects the target electricity such that the decreased illuminance of the lamp 1 is corrected (compensated).

Specifically, the detection result of the optical sensor 15 is converted to the digital signal by the A/D converter 16*b* (see FIG. 1). The digital signal is the illuminance signal of the lamp 1, and is read by the controller 4. The illuminance signal is introduced to the optical sensor sensitivity correction unit 4*c*. The optical sensor sensitivity correction unit 4*c* corrects the illuminance signal with the sensitivity correction value, which corresponds to the emission wavelength, and sends the corrected optical sensor output to the lighting control unit 4*a*.

The lighting control unit 4*a* obtains the corrected illuminance data. If the measured illuminance is lower than the target illuminance 13*d*, the lighting control unit 4*a* calculates the frequency that can achieve the target illuminance, and sends the frequency to the lighting power source 2. The lighting power source 2 causes the lamp 1 to light at this frequency.

In this manner, the lamp 1 is lit at the target illuminance of the lamp 1. Then, every time the illuminance of the lamp 1 drops, then the electricity to be fed to the lamp 1 is increased. Accordingly, it is possible to maintain the illuminance of the lamp 1 at a substantially constant value.

When the lighting of the lamp A is finished, the lamp A on the light source apparatus is replaced with the lamp B (its peak wavelength is, for example, 290 nm). Then, the controller 4 reads the lamp model information from the IC tag provided in the lamp B in the above-described manner at the starting up of the lamp B. The controller 4 checks if the lamp is a compatible lamp which can be used. If the lamp is not a usable lamp, then the controller causes the display unit to indicate the error. If the lamp is a usable lamp, the controller causes the lamp to light in a normal way.

Figure 5:
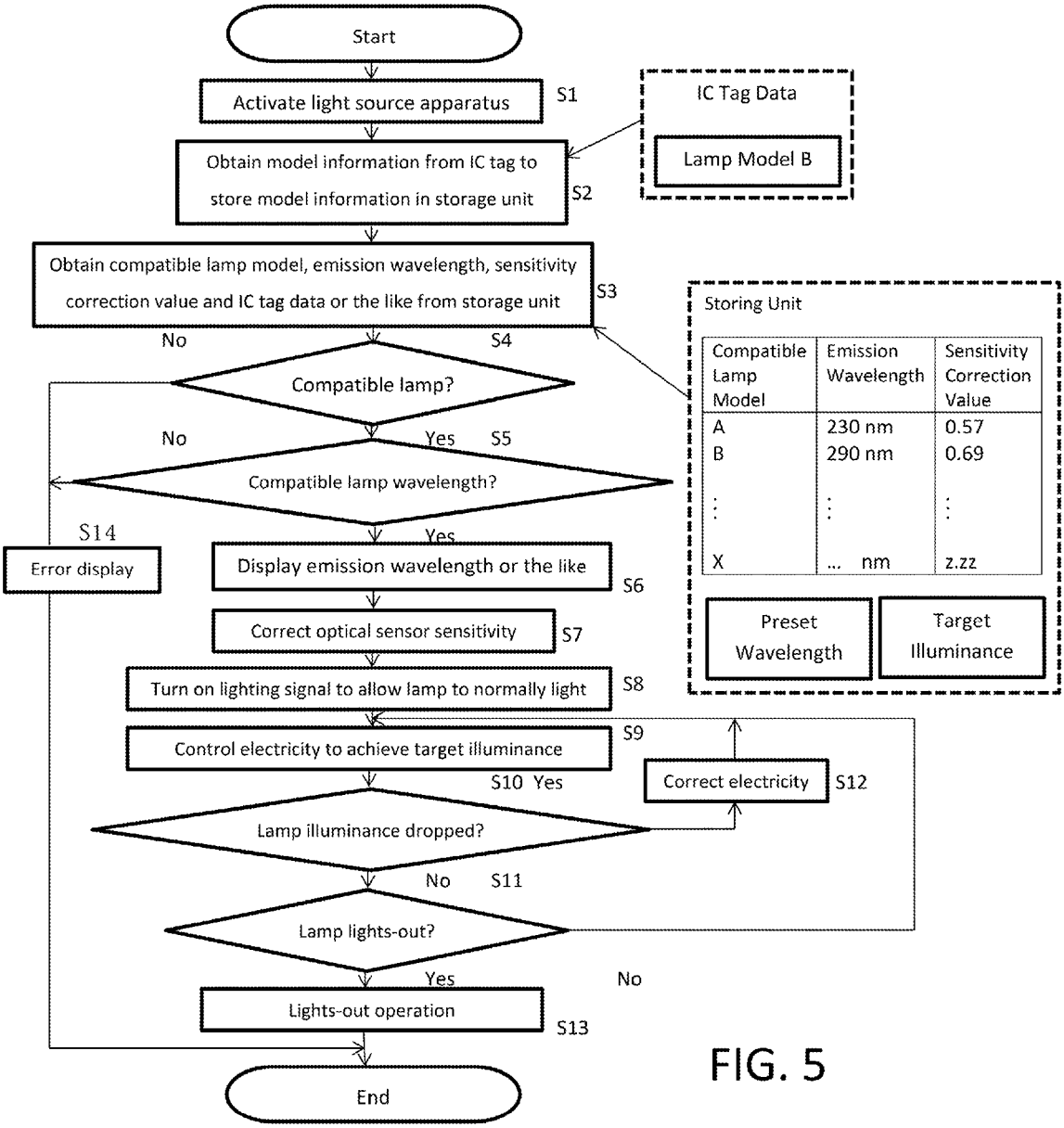
FIG. 5 is a flowchart showing operations of a controller according to the first embodiment of the present invention.

Now, the operations of the light source apparatus of the first embodiment will be described with reference to the flowchart shown in FIG. 5.

Upon starting up of the apparatus (Step S1), the IC tag R/W unit 12 reads the lamp model information, which is the IC tag data 13*b* recorded in the IC tag, and stores the lamp model information in the storage unit 13 (Step S2). Subsequently, the IC tag data 13*b* stored in the storage unit 13 and the compatible lamp information 13*a* stored in the storage unit 13 are retrieved from the storage unit 13. It is checked if the lamp model recorded on the IC tag matches one of the models registered as the compatible lamp information 13*a* (Steps S3 and S4).

If the lamp model recorded on the IC tag matches one of the models registered in the compatible lamp information 13*a* of the storage unit 13, the controller 4 determines that the lamp mounted on the light source apparatus is a compatible lamp, and proceeds to Step S5. If the lamp model recorded on the IC tag does not match any of the models registered in the compatible lamp information 13*a* of the storage unit 13, the controller 4 proceeds to Step S14 and sends an error indicating information, such as "lamp unusable," to the input-and-display unit 5. Then, the controller 4 terminates the processing.

If the controller 4 determines that the lamp mounted on the light source apparatus is a compatible lamp, the controller 4 reads the emission wavelength of the lamp of that model from the compatible lamp information 13*a* stored in the storage unit 13, and compares the emission wavelength with the preset wavelength 13*c* which is stored beforehand in the storage unit 13 to check if the emission wavelength is equal to the preset wavelength 13*c*, i.e., if the emission wavelength of the lamp mounted on the light source apparatus is compatible (Step S5). When the emission wavelength of the lamp is not the preset wavelength 13*c*, then the controller 4 proceeds to Step S14, causes the input-and-display unit 5 to display an error message, as described above, and terminates the processing.

When the emission wavelength of the lamp is the preset wavelength 13*c*, the controller 4 causes the input-and-display unit 5 to display the emission wavelength of the lamp and a message "lamp usable" (Step S6).

Subsequently, the controller 4 reads the optical sensor sensitivity correction value, which corresponds to the emission wavelength of the lamp mounted on the light source apparatus, from the compatible lamp information 13*a* of the storage unit 13, and sets the sensitivity correction value in the optical sensor sensitivity correction unit 4*c* (Step S7).

The controller 4 then turns on the lighting signal and causes the lamp to emit a light in a normal way. The controller 4 controls the electricity such that the illuminance of the lamp becomes the target illuminance (Steps S8 and S9).

The controller 4 obtains the lamp illuminance, which is measured by the optical sensor 15 and corrected by the optical sensor sensitivity correction unit 4*c*, and compares the lamp illuminance with the target illuminance 13*d* to check if the lamp illuminance decreases (Step S10). If the lamp illuminance is lower than the target illuminance 13*d* by a certain value or more, then the controller 4 proceeds to Step S12 to adjust the electricity such that the lamp illuminance becomes the target illuminance 13*d*. Then, the controller 4 returns to Step S9.

When the lamp illuminance does not decrease, the controller 4 proceeds to Step S11 to check if the lamp extinguish signal (lights-out signal) is input. If the lights-out signal is not input, the controller 4 returns to Step S9. If the lights-out signal is input, the controller 4 carries out the extinguishing process to the lamp (Step S13) and terminates the processing.

Second Embodiment

Figure 6:
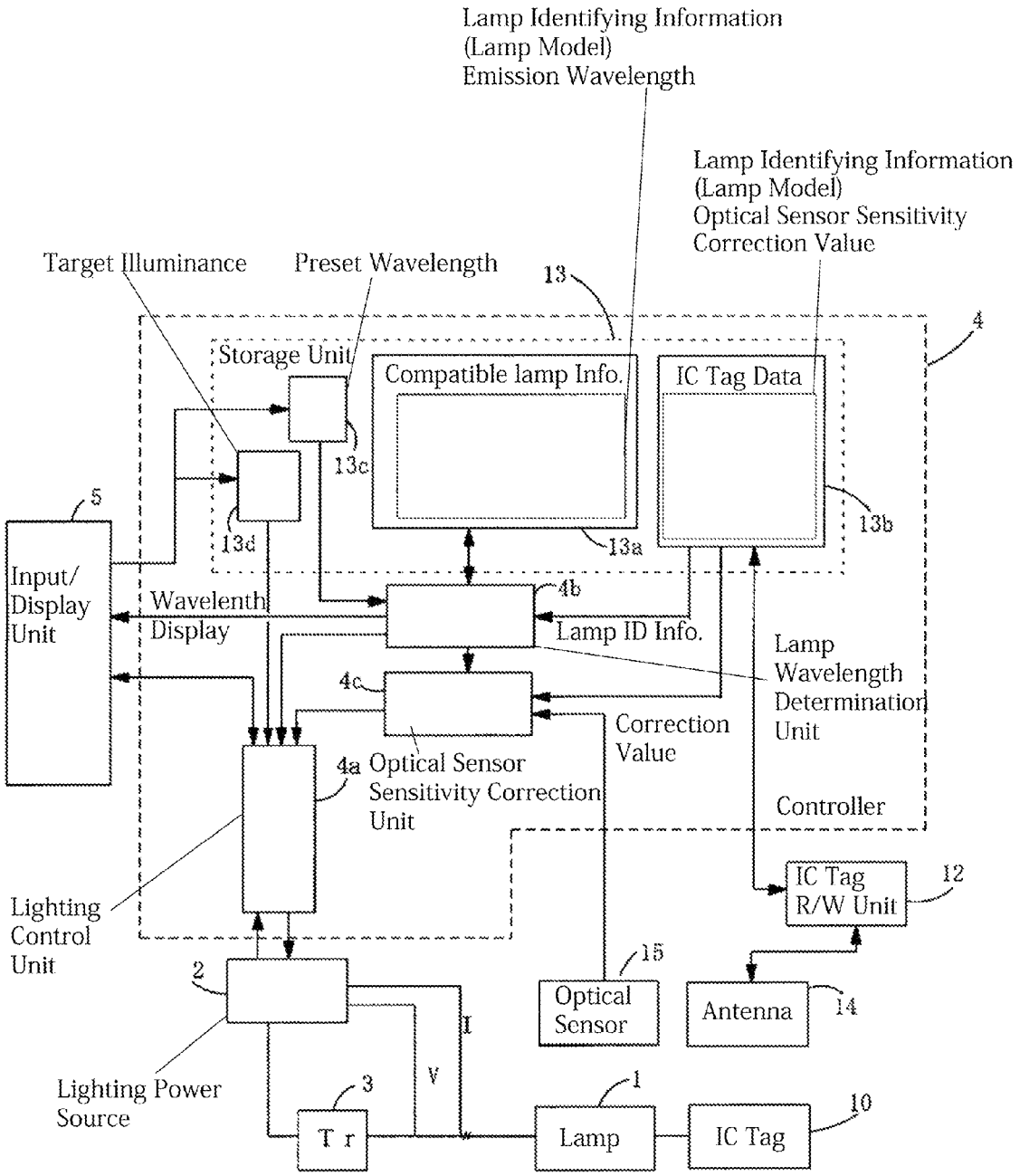
FIG. 6 is a functional block diagram of a light source apparatus according to a second embodiment of the present invention.

FIG. 6 illustrates a functional block diagram of a light source apparatus according to a second embodiment of the present invention. The same or similar reference numerals and symbols are used in the first and second embodiments to designate the same or similar components. FIGS. 7A and 7B illustrate examples of data stored in the storage unit. FIG. 6 depicts the inner configuration of the controller 4 of the second embodiment in the form of functions realized by the processing executed by the CPU 11.

In FIG. 6, information (e.g., lamp model) identifying the lamp 1, to which the IC tag 10 is attached, is stored in the IC tag 10 in the second embodiment. The sensitivity correction value of the optical sensor (see FIG. 7B) which corresponds to the wavelength of the light emitted from the lamp 1 is also stored in the IC tag 10. The lamp 1 is mounted on the light source apparatus. Upon activation of the light source apparatus, the IC tag data 13*b* recorded in the IC tag is read in the above-described manner, and stored in the storage unit 13.

Information necessary to operate the light source apparatus such as the compatible lamp information 13*a*, the target illuminance 13*d*, and the preset wavelength 13*c* is input in advance from the input-and-display unit 5, and stored in the storage unit 13.

FIG. 7B shows one example of the compatible lamp information 13*a* in this embodiment. For example, the lamp model that can be used for the light source apparatus, and the dominant wavelength (emission wavelength) of the light emitted from that model of lamp are registered as the compatible lamp information 13*a*.

In FIG. 6, when the light source apparatus is activated, the IC tag R/W unit 12 reads the model information of the lamp to which the IC tag is attached, and the sensitivity correction value from the IC tag 10 of the lamp 1 mounted on the light source apparatus, and stores the lamp model information and the sensitivity correction value in the storage unit 13.

The lamp wavelength determination unit 4*b* reads the lamp identifying information (lamp model) which is stored in the storage unit 13. Then, the lamp wavelength determination unit 4*b* determines whether the lamp model of the lamp concerned is registered as a compatible lamp in the compatible lamp information 13*a* stored in the storage unit 13. If the lamp model recorded in the IC tag 10 is not included in the listing of compatible lamp models of the compatible lamp information 13*a*, or no tag is attached to the lamp 1 and therefore no lamp identifying information can be obtained from the IC tag 10, then the lamp wavelength determination unit 4*b* sends an alarming signal, which indicates "lamp unusable" or the like, to the input-and-display unit 5.

If the lamp model recorded in the IC tag 10 is included in the listing of the compatible lamp models of the compatible lamp information 13*a*, the lamp wavelength determination unit 4*b* reads an emission wavelength, which corresponds to the lamp model recorded on the IC tag 10, from the compatible lamp information 13*a* and compares the emission wavelength with the preset wavelength 13*c* registered in the storage unit 13 to determine whether the emission wavelength coincides with the preset wavelength 13*c*.

When the emission wavelength read from the compatible lamp information 13*a* does not coincide with the preset wavelength 13*c*, the lamp wavelength determination unit 4*b* sends an alarming signal that indicates "lamp unusable" or the like to the input-and-display unit 5, in the same manner as described above. The lamp wavelength determination unit 4*b* also sends the emission wavelength, which is read from the compatible lamp information 13*a*, to the input-and-display unit 5 to display the emission wavelength on the input-and-display unit 5.

On the other hand, when the emission wavelength read from the compatible lamp information 13*a* coincides with the preset wavelength 13*c*, the lamp wavelength determination unit 4*b* causes the input-and-display unit 5 to display, for example, "lamp usable," and to display the emission wavelength read from the compatible lamp information 13*a*. Then, the lamp wavelength determination unit 4*b* reads the sensitivity correction value, which is read from the IC tag 10 and stored in the storage unit 13, and sets the sensitivity correction value in the optical sensor sensitivity correction unit 4*c*.

When the above-described processing determines that a lamp which is usable and compatible for the light source apparatus is mounted on the light source apparatus, then the lighting control unit 4*a* of the controller 4 starts the lighting process.

The subsequent processing is the same as that described with reference to FIG. 2. The lighting control unit 4*a* controls the lighting power source 2 such that the electricity fed to the lamp 1 is increased to have the target illuminance. As a result, the lamp 1 emits a light at the target illuminance.

On the other hand, the signal representative of the illuminance of the lamp 1 measured by the optical sensor 15 (illuminance signal) is sent to the optical sensor sensitivity correction unit 4*c* of the controller 4. The illuminance signal is corrected by the sensitivity correction value which corresponds to the emission wavelength of the lamp 1 as described above. The corrected optical sensor output is sent to the lighting control unit 4*a*.

As the illuminance of the light emitted from the lamp 1 decreases over time, the lighting control unit 4*a* corrects (adjusts) the electricity such that the decrease in the illuminance of the lamp 1 is corrected.

In this manner, the lamp 1 is lit at the target illuminance of the lamp 1. Then, every time the illuminance of the lamp 1 drops, then the electricity to be fed to the lamp 1 is increased. Accordingly, it is possible to maintain the illuminance of the lamp 1 at a substantially constant value.

Figure 8:
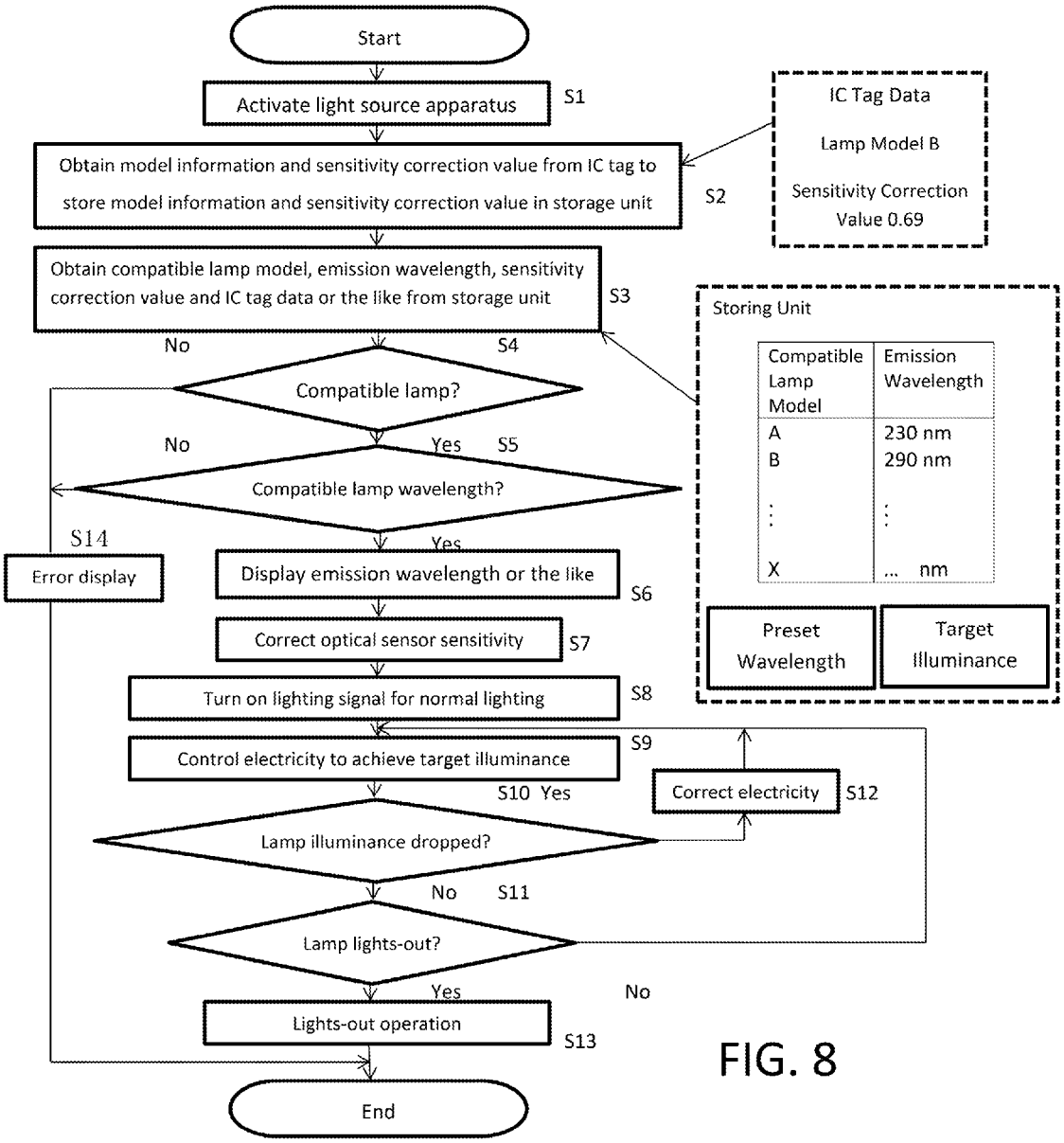
FIG. 8 is a flowchart showing operations of a controller according to the second embodiment of the present invention.

Now, the operations of the light source apparatus of the second embodiment will be described with reference to the flowchart shown in FIG. 8.

Upon activation of the apparatus (Step S1), the IC tag R/W unit 12 reads the lamp model information and the sensitivity correction value, which are the IC tag data 13*b* recorded in the IC tag, and stores the lamp model information and the sensitivity correction value in the storage unit 13 (Step S2). Subsequently, the IC tag data 13*b* and the compatible lamp information 13*a* stored in the storage unit 13 are retrieved from the storage unit 13. It is checked if the lamp model recorded in the IC tag matches one of the models registered as the compatible lamp information 13*a* (Steps S3 and S4).

If the lamp model recorded in the IC tag matches one of the lamp models registered in the compatible lamp information 13*a* of the storage unit 13, the controller 4 determines that the lamp mounted on the light source apparatus is a compatible lamp, and proceeds to Step S5. If the lamp model recorded on the IC tag does not match any of the lamp models registered in the compatible lamp information 13*a* of the storage unit 13, the controller 4 proceeds to Step S14 and sends an error-indicating information, such as "lamp unusable," to the input-and-display unit 5. Then, the controller 4 terminates the processing.

If the controller 4 determines that the lamp mounted on the light source apparatus is a compatible lamp, the controller 4 reads the emission wavelength of the lamp of that model from the compatible lamp information 13*a* stored in the storage unit 13, and compares the emission wavelength with the preset wavelength 13*c* which is stored beforehand in the storage unit 13 to check if the emission wavelength is equal to the preset wavelength 13*c*, i.e., if the emission wavelength of the lamp mounted on the light source apparatus is compatible (Step S5). When the emission wavelength of the lamp is not the preset wavelength 13*c*, then the controller 4 proceeds to Step S14, causes the input-and-display unit 5 to display an error message, as described above, and terminates the processing.

When the emission wavelength of the lamp is the preset wavelength 13*c*, the controller 4 causes the input-and-display unit 5 to display the emission wavelength of the lamp and a message "lamp usable" (Step S6).

Subsequently, the controller 4 reads the optical sensor sensitivity correction value, which corresponds to the emission wavelength of the lamp mounted on the light source apparatus, from the storage unit 13. The optical sensor sensitivity correction value is read from the IC tag 10 and stored in the storage unit 13. The controller 4 sets the sensitivity correction value in the optical sensor sensitivity correction unit 4*c* (Step S7).

The subsequent processing is the same as that described with reference to the flowchart of FIG. 4. The controller 4 turns on the lighting signal and causes the lamp to emit a light in a normal way. The controller controls the electricity such that the illuminance of the lamp becomes the target illuminance (Steps S8 and S9).

The controller 4 obtains the lamp illuminance, which is corrected by the optical sensor sensitivity correction unit 4*c*, and compares the lamp illuminance with the target illuminance 13*d* to check if the lamp illuminance decreases (Step S10). If the lamp illuminance is lower than the target illuminance 13*d* by a certain value or more, then the controller 4 proceeds to Step S12 to adjust the electricity such that the lamp illuminance becomes the target illuminance 13*d*. Then, the controller 4 returns to Step S9.

When the lamp illuminance does not decrease, the controller 4 proceeds to Step S11 to check if the lamp extinguish signal (lights-out signal) is input. If the lights-out signal is not input, the controller 4 returns to Step S9. If the lights-out signal is input, the controller 4 carries out the extinguishing process to the lamp (Step S13) and terminates the processing.

Third Embodiment

The foregoing deals with the light source apparatus that has a single lamp mounted thereon. It should be noted that the present invention is also applicable to a light source apparatus that may have a plurality of lamps mounted thereon.

Figure 9:
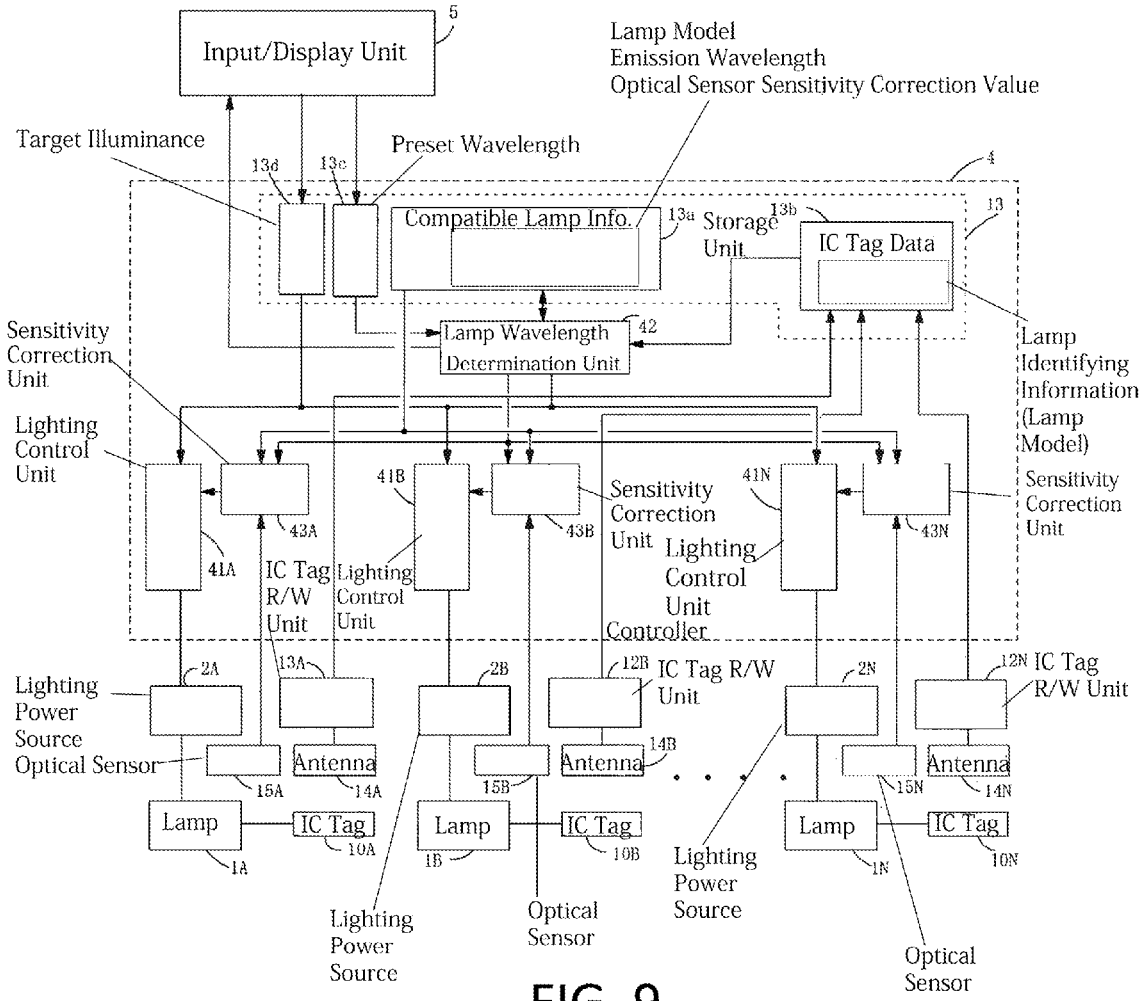
FIG. 9 is a functional block diagram of a light source apparatus according to a third embodiment of the present invention.
Figure 10A:
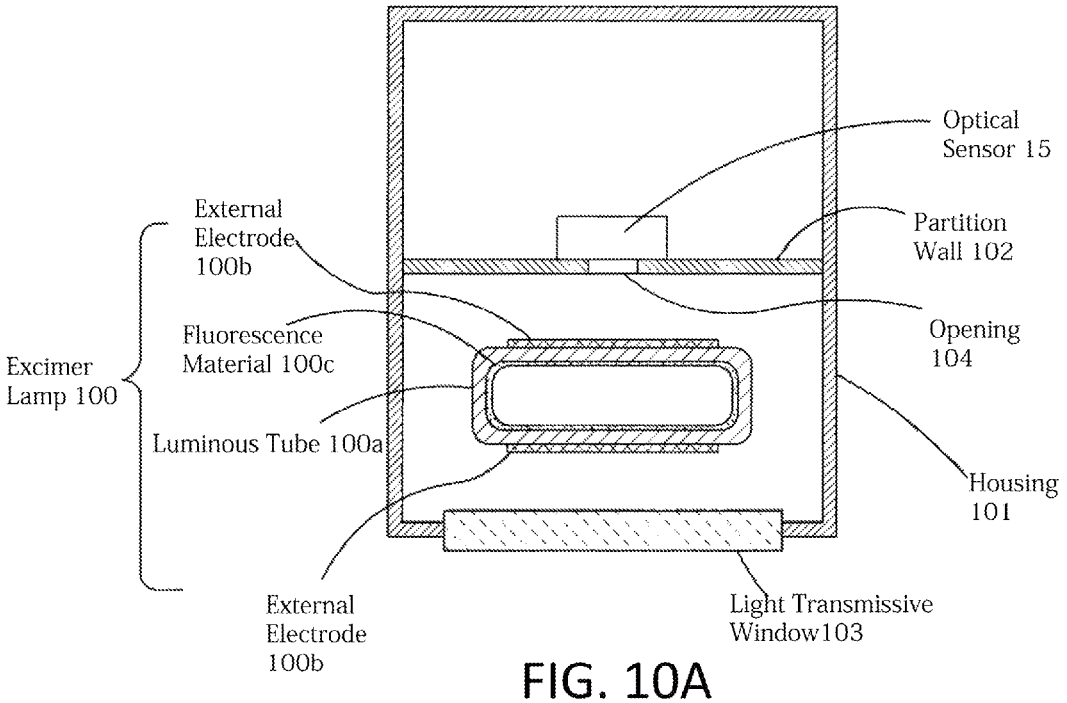
FIG. 10A illustrates a schematic configuration of a light source apparatus to light an excimer lamp.
Figure 10B:
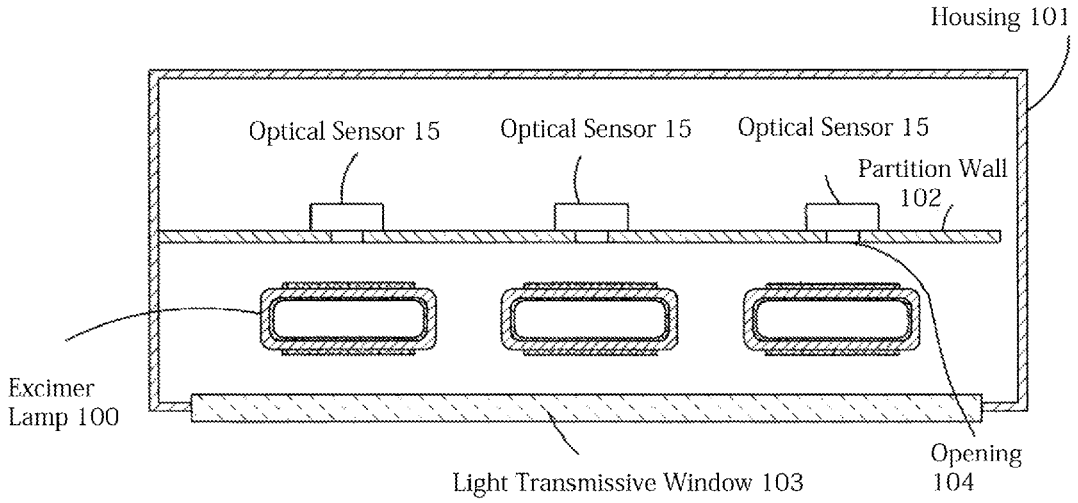
FIG. 10B illustrates a schematic configuration of another light source apparatus adapted to light a plurality of excimer lamps.
Figure 11:
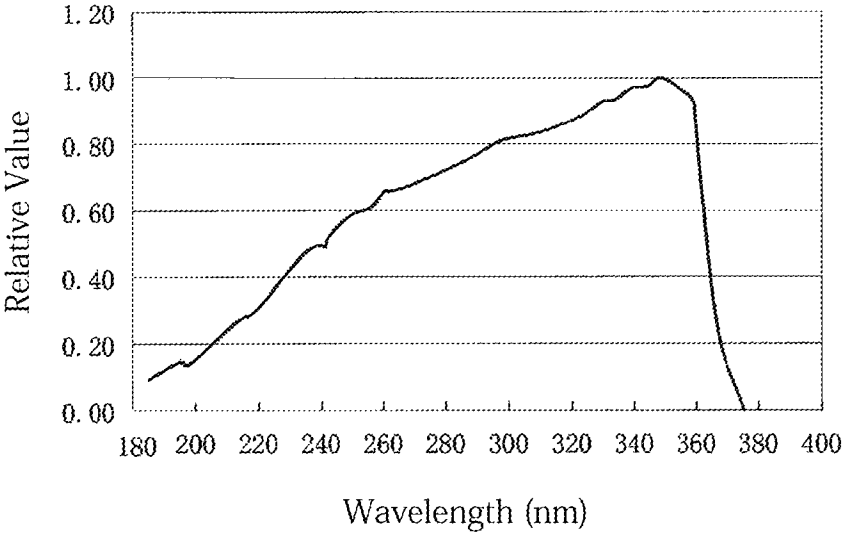
FIG. 11 illustrates an exemplary sensitivity of an optical sensor.

FIG. 9 shows a functional block diagram of a light source apparatus according to the third embodiment of the present invention. The same or similar reference numerals and symbols are used in the first, second and third embodiments to designate the same or similar components. FIG. 9 depicts the inner configuration of the controller 4 of the third embodiment in the form of functions realized by the processing executed by the CPU.

In FIG. 9, a plurality of lamps 1A, 1B, . . . and 1N are to be mounted on the light source apparatus of the third embodiment. A plurality of IC tags 10A, 10B, . . . and 10N are to be attached to (associated with) the lamps 1A, 1B, . . . , and 1N, respectively.

The lamps 1A-1N have associated optical sensors 15A-15N, antennae 14A-14N, IC tag R/W units 12A-12N and lighting power sources 2A-2N, respectively. The controller 4 possesses a plurality of lighting control units 41A-41N for the lighting power sources 2A-2N, respectively. The controller 4 also possesses a plurality of sensitivity correction units 43A-43N for the optical sensors 15A-15N, respectively.

In the third embodiment, the IC tags 10A-10N attached to the lamps 1A-1N store the information (e.g., lamp model) that identifies the associated lamps, respectively.

When the lamps 1A-1N are mounted on the light source apparatus and the light source apparatus is activated, the IC tag data 13*b* recorded in the IC tags 10A-10N of the respective lamps are read via the antennae 14A-14N and the IC tag R/W units 12A-12N, and stored in the storage unit 13.

Information (e.g., the compatible lamp information 13*a*, the target illuminance 13*d*, and preset wavelength 13*c*) necessary to operate the light source apparatus is input beforehand from the input-and-display unit 5, and such information is stored in the storage unit 13.

The preset wavelength 13*c* is information to set the wavelength of the light to be emitted from the light source apparatus, as described earlier. The target illuminance 13*d* is a target value when the illuminance is feedback controlled.

The compatible lamp information 13*a* of the third embodiment is the same as that shown in FIG. 2B. For example, the models of the lamps compatible for the light source apparatus, the dominant wavelengths (emission wavelengths) of the lights emitted from such models of the lamps, and the sensitivity correction values of the optical sensors are registered as the compatible lamp information 13*a*.

In FIG. 9, when the light source apparatus is activated, the IC tag R/W units 12A-12N read the IC tag data 13*b* from the IC tags 10A-10N of the respective lamps 1A-1N mounted on the light source apparatus, and store the IC tag data 13*b* in the storage unit 13.

The lamp wavelength determination unit 42 reads the lamp identifying information (e.g., lamp models) which is the information of the lamps mounted on the light source apparatus. The lamp identifying information is stored in the storage unit 13.

Then, the lamp wavelength determination unit 42 determines whether each of the lamp models of the lamps, which are read from the IC tags 10A-10N, is registered as a compatible lamp in the compatible lamp information 13*a* stored in the storage unit 13. If the lamp model recorded in the IC tag 10 concerned is not included in the listing of compatible lamp models of the compatible lamp information 13*a*, or no tag is attached to the lamp 1 concerned and therefore no lamp specifying information can be obtained from the IC tag 10 concerned, then the lamp wavelength determination unit 42 identifies which lamp is incompatible, and sends an alarming signal, which represents a message such as "lamp #m is unusable" or the like, to the input-and-display unit 5.

If the lamp model recorded in the IC tag 10 (10A-10N) concerned is included in the listing of the compatible lamp models of the compatible lamp information 13*a*, the lamp wavelength determination unit 42 reads an emission wavelength, which corresponds to the lamp model recorded on the IC tag 10 concerned, from the compatible lamp information 13*a* and compares the emission wavelength with the preset wavelength 13*c* registered in the storage unit 13 to determine whether the emission wavelength coincides with the preset wavelength 13*c*.

When the emission wavelength read from the compatible lamp information 13*a* does not coincide with the preset wavelength 13*c*, the lamp wavelength determination unit 42 sends an alarming signal that indicates "lamp #m unusable" or the like to the input-and-display unit 5, in the same manner as described above. The lamp wavelength determination unit 42 also sends the emission wavelength, which is read from the compatible lamp information 13*a*, to the input-and-display unit 5 to display the emission wavelength on the input-and-display unit 5.

On the other hand, when the emission wavelength read from the compatible lamp information 13*a* coincides with the preset wavelength 13*c*, the lamp wavelength determination unit 42 causes the input-and-display unit 5 to display, for example, "lamp usable," and to display the emission wavelength read from the compatible lamp information 13*a*. Then, the lamp wavelength determination unit 42 reads from the compatible lamp information 13*a* the sensitivity correction value that corresponds to the lamp model recorded on the IC tag 10 (10A-10N) concerned, and sets the sensitivity correction value into the optical sensor sensitivity correction unit 43 (43A-43N) concerned.

When the above-described processing determines that the lamp concerned, mounted on the light source apparatus, is compatible for the light source apparatus, then the associated lighting control unit 41 (41A-41N) of the controller 4 starts the lighting process for the lamp concerned.

The operation of each of the lighting control units 41A-41N is the same as that described in the first and second embodiments. The lighting control units 41A-41N control the associated lighting power sources 2A-2N to increase the electricity fed to the associated lamps 1A-1N such that the lamps 1A-1N emit lights at the target illuminance. As a result, the lamps 1A-1N emit the lights at the target illuminance.

The signals representative of the illuminances of the lamps 1A-1N measured by the associated optical sensors 15A-15N are introduced to the optical sensor sensitivity correction units 43A-43N in the controller 4. The optical sensor sensitivity correction units 43A-43N correct the illuminance signals with the respective sensitivity correction values, which correspond to the emission wavelengths of the lamps 1A-1N, as described above, and sends the corrected optical sensor outputs to the respective lighting control unit 41A-41N.

As the illuminances of the lights emitted from the lamps 1A-1N decrease over time, the lighting control units 41A-41N correct (adjust) the electricity to be fed to the associated lamps such that the decreases in the illuminance of the lamps 1A-1N are corrected respectively.

In this manner, the lamps 1A-1N are lit at the target illuminances of the lamps 1A-1N, respectively. Then, every time the illuminance of the lamp 1 (1A-1N) concerned drops, then the electricity to be fed to the lamp 1 is increased. Accordingly, it is possible to maintain the illuminances of the lamps 1A-1N at a substantially constant value.

While certain embodiments have been described, these embodiments have been presented by way of example only, and are not intended to limit the scope of the present invention. The novel apparatuses (devices) and methods thereof described herein may be embodied in a variety of other forms; furthermore, various omissions, substitutions and changes in the form of the apparatuses (devices) and methods thereof described herein may be made without departing from the gist of the present invention. The accompanying claims and their equivalents are intended to cover such forms or modifications as would fall within the scope and gist of the present invention.

The present application is based upon and claims the benefit of a priority from Japanese Patent Application No. 2013-051433, filed Mar. 14, 2013, and the entire contents of which are incorporated herein by reference.

What is claimed is:

1. A light source apparatus comprising:

a lighting power source configured to feed electricity to an excimer lamp at which an IC tag is disposed;

an IC tag reading unit configured to read information from the IC tag disposed at the excimer lamp;

an optical sensor configured to measure illuminance of a light emitted from the excimer lamp that is lighting; and a controller configured to control the lighting power source according to an output from the optical sensor to control the illuminance of the light of the excimer lamp, the lighting power source being configured to be shared among excimer lamps that have an equal lighting condition and different emission wavelengths, the controller being configured to store at least usable lamp information identifying an excimer lamp that is usable for the light source apparatus, and a sensitivity correction value for correcting a sensitivity of the optical sensor that corresponds to an emission wavelength of each usable excimer lamp, the IC tag being configured to store at least lamp identifying information identifying an excimer lamp at which the IC tag is disposed, the controller being configured, when the light source apparatus is driven to cause the excimer lamp to light, to determine whether the excimer lamp mounted on the light source apparatus is usable and capable of emitting a light at a desired emission wavelength based on the lamp identifying information read from the IC tag by the IC tag reading unit and the usable lamp information stored in the controller, and the controller being configured, if the controller determines that the excimer lamp is usable and capable of emitting the light at the desired emission wavelength, to allow the excimer lamp to normally light and correct the sensitivity of the optical sensor with the sensitivity correction value.

2. The light source apparatus according to claim 1, wherein the excimer lamp is a xenon excimer lamp that has a luminous tube encapsulating a rare gas therein, or a fluorescent excimer lamp that has a luminous tube encapsulating a rare gas therein and is provided with a phosphor excited by a light from the rare gas.

3. A light source apparatus comprising:

a lighting power source configured to feed electricity an excimer lamp at which an IC tag is disposed;

an IC tag reading unit configured to read information from the IC tag disposed at the excimer lamp;

an optical sensor configured to measure illuminance of a light emitted from the excimer lamp that is lighting; and a controller configured to control the lighting power source according to an output from the optical sensor to control the illuminance of the excimer lamp, the lighting power source being configured to be shared among excimer lamps that have an equal lighting condition and different emission wavelengths, the controller being configured to store at least usable lamp information identifying an excimer lamp that is usable for the light source apparatus, the IC tag being configured to store at least lamp identifying information identifying an excimer lamp at which the IC tag is disposed, and a sensitivity correction value for correcting a sensitivity of the optical sensor that corresponds to an emission wavelength of the excimer lamp at which the IC tag is disposed, the controller being configured, when the light source apparatus is driven to cause the excimer lamp to light, to determine whether the excimer lamp mounted on the light source apparatus is usable and capable of emitting a light at a desired emission wavelength based on the lamp identifying information read from the IC tag by the IC tag reading unit and the usable lamp information stored in the controller, and the controller being configured, if the controller determines that the excimer lamp is usable and capable of emitting the light at the desired wavelength, to allow the excimer lamp to normally light and correct the sensitivity of the optical sensor with the sensitivity correction value read from the IC tag.

4. A light source apparatus usable for a plurality of excimer lamps, with a plurality of IC tags being disposed at the plurality of excimer lamps, respectively, the light source apparatus comprising:

a plurality of lighting power sources associated with the plurality of excimer lamps, respectively, each said lighting power source configured to feed electricity to the associated excimer lamp;

a plurality of IC tag reading units associated with the plurality of excimer lamps, respectively, each said IC tag reading unit configured to read information from the associated IC tag disposed at the associated excimer lamp;

a plurality of optical sensors associated with the plurality of excimer lamps, respectively, each said optical sensor configured to measure illuminance of a light emitted from the associated excimer lamp that is lighting; and a controller configured to control each of the lighting power sources based on an output from the associated optical sensor to control the illuminance of the associated excimer lamp, the controller being configured, when the excimer lamps are mounted on the light source apparatus, to determine whether an emission wavelength of each of the excimer lamps is identical with an emission wavelength of another excimer lamp based on the lamp identifying information read from the IC tag disposed at the each of excimer lamps, and the controller being configured, if the emission wavelength of the each of the excimer lamps is determined to be identical with the emission wavelength of said another excimer lamp, to allow the each of the excimer lamps to normally light.

* * * * *